United States Patent [19]

Niedworok

[11] 4,434,871

[45] Mar. 6, 1984

[54] EMERGENCY ESCAPE LADDER

[76] Inventor: Johannes F. Niedworok, Rte. 4, Box 300, Sanford, N.C. 27330

[21] Appl. No.: 471,878

[22] Filed: Mar. 3, 1983

[51] Int. Cl.[3] ..... E06C 1/36; E06C 1/56; E06C 1/58

[52] U.S. Cl. ..... 182/198; 182/22; 182/206

[58] Field of Search ..... 182/206, 196, 197, 198, 182/93, 40, 41, 163, 164, 22, 21

[56] References Cited

U.S. PATENT DOCUMENTS

| | | | |
|---|---|---|---|
| 406,257 | 7/1889 | Butler | 182/198 |
| 800,934 | 10/1905 | McArthur | 182/198 |
| 1,177,557 | 3/1916 | White | 182/164 |
| 1,909,231 | 5/1933 | Sonetto | 182/198 |
| 2,223,980 | 12/1940 | Zent | 182/197 |
| 2,615,665 | 10/1952 | Baxter | 182/198 |
| 4,143,741 | 3/1979 | Souza | 182/198 |
| 4,157,130 | 6/1979 | Aberer | 182/198 |

*Primary Examiner*—R. P. Machado
*Attorney, Agent, or Firm*—Mills & Coats

[57] ABSTRACT

The present invention entails an emergency escape ladder that can be used to descend from one level of a building downwardly to another level, after which the ladder may be repeatedly repositioned for descending on downwardly in a like manner. Functionally the emergency escape ladder includes a plurality of treads interconnected by a pair of flexible tie lines in the form of chains. Because of the flexible chains, the emergency escape ladder may assume an inoperative position where the same can be folded and stored in a compact area. Further, the emergency escape ladder is provided with a plurality of stabilizing bars that are secured together in end-to-end relationship, with said treads sandwiched therebetween. When the stabilizing bars are interconnected between treads, the ladder assumes an operative mode or position where the same is elongated and generally rigid. Finally, the emergency escape ladder of the present invention includes about its upper end both a hook structure for enabling the ladder to be secured around a window ledge, and a cable and latch assembly. The cable and latch assembly enables the entire ladder to be tied to an object within the structure or to be tied to a part of the structure itself. In the case of a fire, or other emergency occurrence, the cable can be utilized as further security for supporting the ladder in a depending position, or in the case where the hook structure is not compatible with a window ledge or the like, there the cable can serve as the sole support for the ladder in a depending position.

17 Claims, 3 Drawing Figures

EMERGENCY ESCAPE LADDER

FIELD OF INVENTION

The present invention relates to ladders, and more particularly to emergency escape ladders for descending from a building that may be on fire or experiencing some other emergency that prohibits exiting from the building in an ordinary manner.

BACKGROUND OF INVENTION

Emergency escape ladders are known in the prior art. For example, see the disclosures found in U.S. Pat. Nos. 3,165,168; 1,910,546; 588,389; 289,220; and 119,161.

While emergency escape ladders are known in the prior art, they have many drawbacks and disadvantages, and as a result have not been widely accepted and used. In this regard, many emergency escape ladders of the prior art are very difficult to handle and use. Often these emergency escape ladders are not designed such that they can be easily hung from a window ledge or some associated structure in and around the area where the emergency escape ladder descends from. Emergency escape ladders of the prior art have been generally designed such that they are bulky, very difficult to handle and position, and require substantial area to store when not in use. Because of the design of such emergency escape ladders, the safety of them is also questionable. As a result, individuals have been reluctant to use such emergency escape ladders of the prior art.

Also emergency escape ladders of the prior art, as referred to above, are often designed to be compatible with one type of building design. Consequently the design is not universal and the applicability of the emergency escape ladder is very limited.

Finally some emergency escape ladders of the prior art are designed to be used to descend from a building from a single hanging of the ladder. Thus, in very tall structures such designs are totally impractical because of the length or height required for the ladder. A more reasonable approach, such as reflected in the present invention, is to provide a design that is capable of allowing an individual to move from one floor level to another floor level after which the entire ladder assembly can be repositioned for continuous descent.

SUMMARY OF THE INVENTION

The present invention presents an emergency escape ladder that is designed to overcome the problems and disadvantages of emergency escape ladders of the prior art. In accomplishing this, the emergency escape ladder of the present invention is designed such that the entire ladder assembly can be easily folded in a relatively small storage area. In addition, when the emergency escape ladder is placed in an operative mode of operation, the same assumes a generally rigid posture that allows the individual using the same to descend from a structure one floor level at a time and to reposition the emergency escape ladder for continuous descent, one floor at a time.

Structurally, the emergency escape ladder of the present invention includes a plurality of treads interconnected together by a pair of flexible chains, with each chain being secured to the respective sides of the treads. About an upper end of the ladder assembly there is provided a hook structure for allowing the entire ladder to be supported by a window ledge or other like support structure forming a part of the building structure being vacated. Also associated with the upper portion of the ladder is a cable and latch assembly. The cable is designed such that it can be secured about an object located in the building being vacated to provide additional or sole support for the ladder while an individual is descending downwardly thereon. Once the individual has reached a lower level, the latch assembly can be actuated, releasing the cable in order that the entire ladder assembly can be repositioned.

To give the ladder assembly rigidity, there is provided a plurality of the elongated stabilizing bars. The respective stabilizing bars are screwed together in end-to-end relationship with the respective treads being sandwiched therebetween. Consequently, the entire ladder assembly assumes a rigid posture which enables the same to be easily and conveniently handled and repositioned.

It is, therefore, an object of the present invention to provide an emergency escape ladder that overcomes the disadvantages, problems, and shortcomings of emergency escape ladders of the prior art.

A further object of the present invention is to provide an emergency escape ladder design that is safe and effective.

Another object of the present invention resides in the provision of an emergency escape ladder that is relatively simple, easy to handle, and which is adapted to assume a foldable compact position when not in use for convenient storage.

Another object of the present invention resides in the provision of an emergency escape ladder that is of a lightweight construction and which can be handled, moved, and repositioned by a single individual.

A further object of the present invention is to provide an emergency escape ladder that is easily securable to some form of support structure associated with the building being vacated or to an object within that building structure.

More specifically, it is an object of the present invention to provide an emergency escape ladder that includes a cable and latch assembly wherein the cable is operative to be secured about an object within said structure, such as a desk, chair, or the like, wherein said emergency escape ladder can be supported by said object or a part of the structure itself while an individual descends downwardly thereon, and wherein said latch assembly can be actuated to release the cable from said objects such that the entire ladder can be repositioned.

Another object of the present invention resides in a method and an apparatus for escaping from a multistory building structure wherein the escaping individual or individuals moves downwardly one floor at a time, repositioning an emergency escape ladder after descending downwardly thereon from one floor to another floor level.

Still a further object of the present invention resides in the provision of an emergency escape ladder of the character referred to above that includes nonflammable treads.

It is also an object of the present invention to provide a sturdy emergency escape ladder that may assume an inoperative folded position for storage, but which in an operative move is generally rigid.

Still a further object of the present invention resides in the provision of an emergency escape ladder of the character referred to above which can be used to climb upwardly on or climb downwardly.

Another object of the present invention resides in the provision of an emergency escape ladder that is compatible with a friction brake type harness assembly that will prevent the individual utilizing the emergency escape ladder from inadvertently falling off the same.

Still a further object of the present invention resides in an emergency escape ladder that is designed such that the same can be used in various locations about, in, and around a multi-story building structure, including both external and internal escape routes.

Other objects and advantages of the present invention will become apparent from a study of the following description and the accompanying drawings which are merely illustrative of the present invention.

EMERGENCY ESCAPE LADDER

Figure 1:
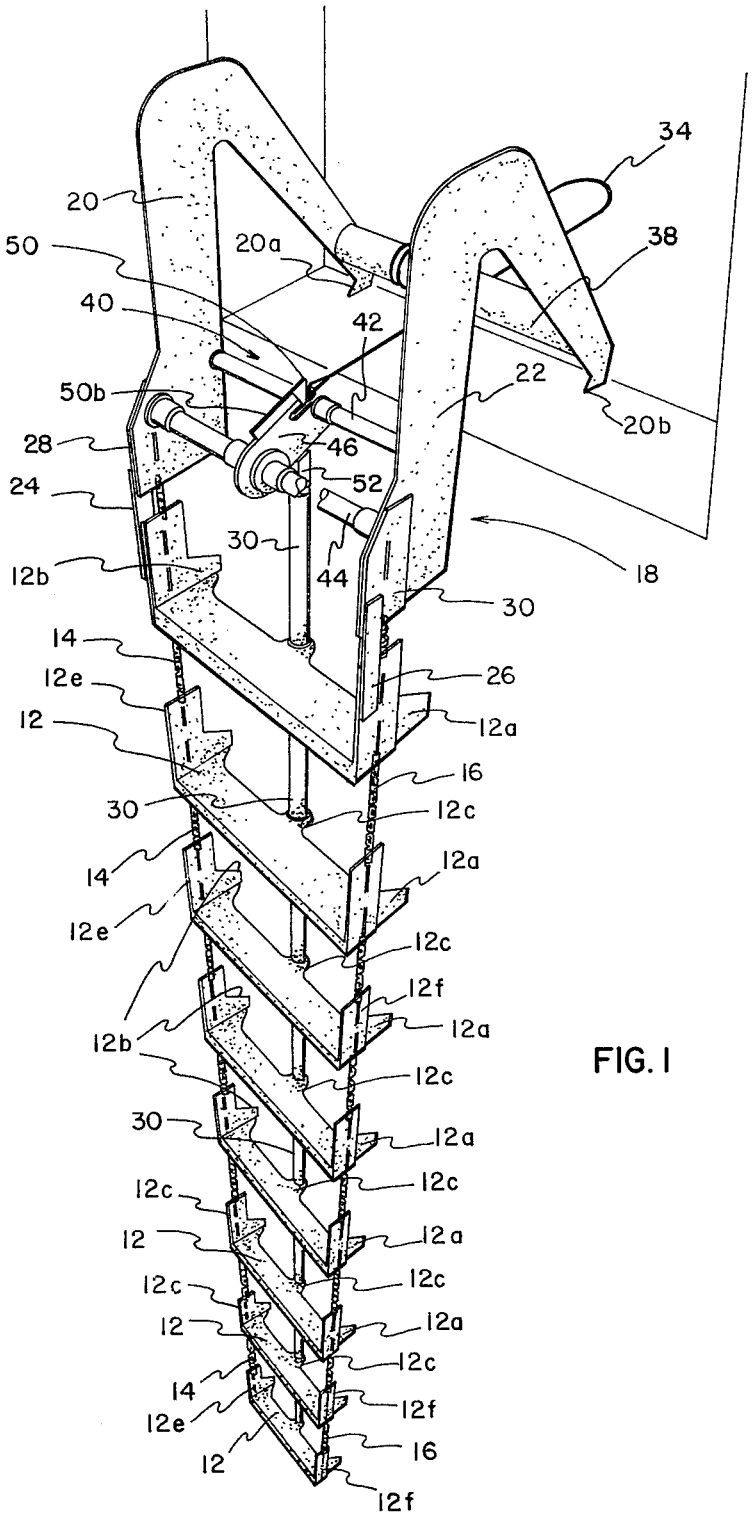
FIG. 1 is a perspective view of the emergency escape ladder of the present invention, shown hanging from a window ledge of a multi-story building structure.

With further reference to the drawings, the emergency escape ladder of the present invention is shown therein indicated generally by the numeral 10. In FIG. 1 emergency escape ladder 10 is disposed in a hanging position about the exterior of a structure with the ladder being secured about its upper portion on a window ledge.

Viewing emergency escape ladder 10 structurally, it is seen that the same comprises a plurality of spaced apart treads 12. Each tread includes a flat plate like step surface that includes a pair of inwardly extensions **12*a* and 12*b*. Intermediately disposed between inward extensions 12*a* and 12*b* is an intermediate extension 12*c* which includes an opening 12*d*. From subsequent portions of this disclosure, one will appreciate the utility and use that is made of opening 12*d* in each of the treads 12. In addition, each tread includes a pair of upstanding sides 12*e* and 12*f***.

The respective treads 12 are connected by flexible tie means in the form of a pair of chains 12 and 14. Each chain 12 or 14 is connected to a respective side **12*e* and 12*f* of treads 12. Consequently, it is appreciated that with the treads only interconnected by chains 14 and 16, that the entire emergency escape ladder 10** would be flexible and consequently could be rolled up or folded into a compact storage position.

Connected to the uppermost tread is a hook shape support structure, indicated generally by the numeral 18. Hook shape support structure 18 includes a pair of laterally spaced arms 20 and 22 that include spiked ends **20*a* and 20*b*. Secured to the lower outside area of arms 20 and 22 is a pair of side members 28 and 30 that resemble the respective sides 12*e* and 12*f* of treads 12. Chains 14 and 16 extend from the uppermost tread to side members 28 and 30 and are connected thereto so as to intergrally connect the plurality of treads 12 with the upper hook support structure 18. In addition, a pair of metal straps 24 and 26 are interconnected between sides 12*e* and 12*f* of the upper tread 12 and side members 28 and 30 of hook support structure 18**.

As noted above, the emergency escape ladder 10 as just described is flexible because the respective treads 12 are only interconnected by flexible chains 12 and 14. But in use it is preferable that the entire emergency escape ladder 10 assume a more rigid posture.

Figure 3:
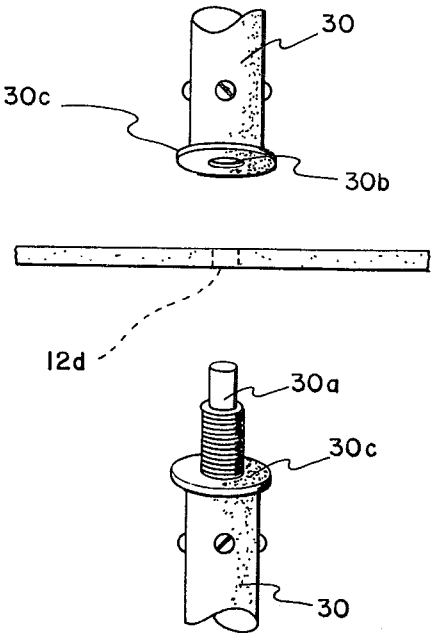
FIG. 3 is a view illustrating the stabilizing bars of the emergency escape ladder and how they are secured end-to-end in conjunction with the treads to form a rigid ladder structure.
Figure 2:
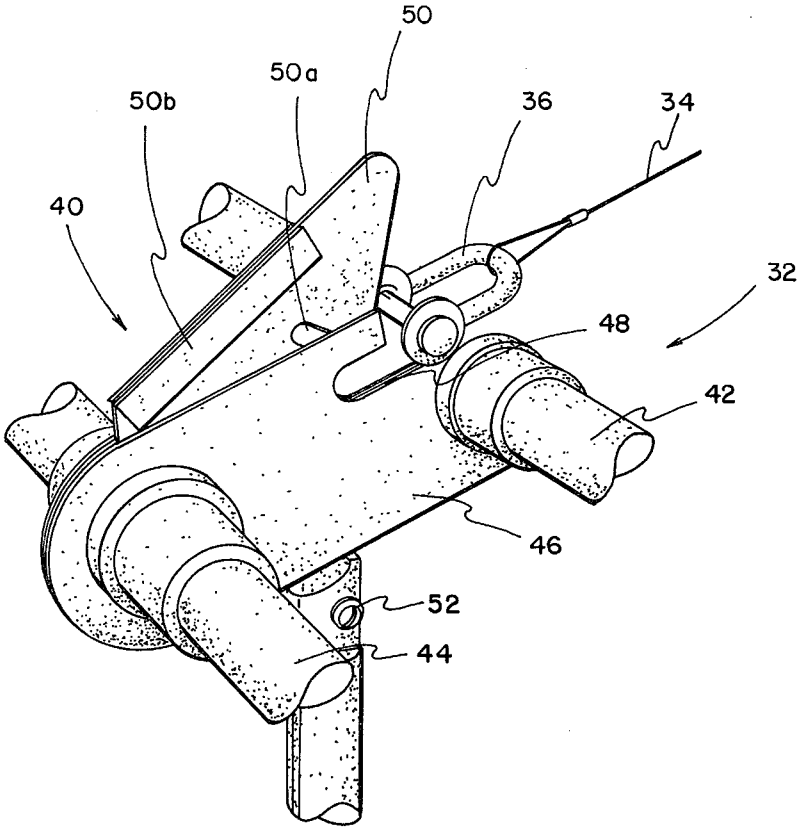
FIG. 2 is a perspective view of a portion of said emergency escape ladder of the present invention, illustrating the cable and latch assembly thereof.

To accommodate this requirement, the emergency escape ladder 10 of the present invention is provided with a plurality of stabilizing bars 30 secured end to end and operatively interconnected to respective treads 12. Viewing FIG. 3, it is seen that each stabilizing bar includes a threaded stud end **30*a* and a threaded bore 30*b* formed on an end opposite the threaded stud 30*a*. In addition, each stabilizing bar 30 includes a circular flange 30*c* formed about both ends, as illustrated in FIG. 3**.

In use, the respective stabilizing bars 30 are secured together in end-to-end relationship. To effectively integrate the treads 12 with the stabilizing bars 30, the stud end **30*a* is inserted into and through opening 12*d* formed within each tread 12. The stabilizing bars 30 are then screwed together in a relatively tight fit. This is illustrated in FIG. 1**.

In descending from one level to a lower level the emergency escape ladder of the present invention can be oriented and positioned as shown in FIG. 1. In FIG. 1, arms 20 and 22 extend over and around a window ledge and consequently the ladder 10 is supported thereby.

To provide additional support, or to provide sole support where the hook support assembly 18 will not fit or is not compatible with a window ledge or the like, there is provided a cable and latch assembly, indicated generally by the numeral 32, that is incorporated into the structure of the hook support assembly 18.

Viewing cable and latch assembly 32, it is seen that the same includes a flexible elongated cable 34 that includes an end connector or clevis 36. Cable 34 is operatively wound around a ratchet take-up bar or reel 38 that is rotatively mounted between arms 20 and 22 about the spiked ends thereof. Take-up bar 38 is of the ratchet type and can be selectively actuated to release segments of cable 34 therefrom. In a support mode, ratchet take-up bar 38 would not rotate and would effectively prevent additional cable from winding off take-up bar 38. Details of the ratchet provided with take-up bar 38 are not disclosed herein in detail because such is not per se material to the present invention and also because individuals skilled in the art appreciate such ratchet design.

Extending transversely in spaced apart relationship between arms 20 and 22 is a pair of latch support bars 42 and 44. Operatively interconnected between bars 42 and 44 is a latch assembly indicated generally by the numeral 40. Latch assembly 40 includes a latch housing 46 that includes an elongated cutout 48. Pivotly mounted about the axis of latch support bar 44 is a latching plate 50 that includes a cutout **50*a* formed therein. Latching plate 50 is operatively connected to the uppermost stabilizing bar 30 through a connector mechanism 52. Consequently, the latching plate 50 is movable relative to latching housing 46 about the axis of support bar 42 by moving the connecting stabilizing bars. It is seen that a stop 54 is formed about the upper edge of latching plate 50 which effectively engages latch housing 36** when the latch assembly is in the downwardly locked position.

When the emergency escape ladder 10 is not being used, the respective stabilizing bars 30 would be disconnected therefrom and the entire ladder assembly 10 could be folded into a compact position and stored.

To prepare emergency escape ladder 10 to be used, the same can be stretched out over a flat surface such as a floor. In this position, the respective stabilizing bars 30 can be connected together with the respective treads 12 being sandwiched between flanges 30*c* formed about opposite ends of respective stabilizing bars 30. The lowermost stabilizing bar 30 may have a bolt extending through opening 12*d* of the lowermost tread and on into the threaded bore 12*b* of the lower most stabilizing bar 30. In addition the stud end 30*a* of the uppermost stabilizing bar can be screwed into a connector mechanism 52 that is directly coupled to latching plate 50.

The emergency escape ladder 10 of the present invention can be utilized to descend from one level in a building structure to a lower level. In case of fire, smoke or other types of emergency that effectively cut off normal exits, the assembled emergency escape ladder 10 can be utilized to move downwardly, one floor at a time. The ladder can be used for external or internal escape, but typically will be used as an external escape downwardly along the exterior side of a building. For example, one could escape a building by moving from one balcony area to another balcony area by utilizing the emergency escape ladder 10 of the present invention.

In many cases, the hook support structure 18 can be fitted over the window ledge of a building being vacated, such as illustrated in FIG. 1. The individual escaping can then step down the ladder to the lower adjacent floor level. When the individual reaches the next adjacent lower floor level, the entire assembled emergency escape ladder 10 can be moved from the upper floor window and repositioned with the hook support structure being fitted around the window ledge on the floor level now reached by the individual. This process is continued floor level by floor level until the individual reaches the bottom of the structure or is otherwise rescued.

In some occasions, it might be desirable to provide additional support security for the emergency escape ladder 10 of the present invention. This can be in conjunction with support security provided by the hook support structure 18 or independently thereof. In any event, cable end 36 is released from the latch assembly 38 by either pulling the hook support 18 forwardly or raising latch plate 50 by effectively raising stabilizing bars 30. Cable end or clevis 36 may be wound around an object in a room such as a chair, desk, sofa or the like and returned to the latch assembly 40 where the clevis 36 is latched in place. Consequently, the entire emergency escape ladder 10 is supported by the object the cable 34 is wound around. Once the individual reaches the next lower level, the individual can raise the ladder 10 by simply pushing up on the stabilizing bars 30 which will effectively raise latching plate 50 with respect to latch housing 46. Such will free clevis 36 and will enable the entire ladder 10 including the cable and latch assembly 32 to be lowered down to the next lower level where the individual escaping the building structure is situated. From that point on, the same process as outlined above can be utilized to reach an area of safety.

Although not particularly disclosed herein, the escape ladder 10 is particularly suitable to be used with a harness and brake assembly. In such an arrangement, it is contemplated that the harness would include a series of body straps adjustable to fit different body sizes. The harness should fit an individual at or around the chest area and would be operatively connected to a safety brake. The safety brake would be constructed of a cable drum with a steel hand brake on the sides. Under low tension, for example, when an individual is climbing, the cable will roll out without any restrictions. Should the climber fall, a guide where the cable exits the drum will pull the steel bands tight and keep it from releasing any additional cable length. This will reduce the impact of the individual against the ladder. It is contemplated that such a cable would be approximately twenty feet long, one-eighth inch in diameter, and made of stainless steel. The test strength of such a cable should be at least twelve-hundred pounds.

From the foregoing discussion and specification, it is appreciated that the present invention presents a practical and safe emergency escape ladder that when used will and can save lives. Of particular importance is the fact that the emergency escape ladder of the present invention is of a lightweight construction and can be easily handled and used, and which is particularly designed such that in an inoperable mode the same can be reduced to a folded compact position. Notwithstanding the above, the emergency escape ladder of the present invention includes a very reliable retaining design that enables the ladder to be secured by either arms 20 and 22 and/or the cable and latch assembly 32 in a safe manner.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claim are intended to be embraced therein.

What is claimed is:

1. An emergency escape ladder adapted to assume a folded inoperative position and a rigid operative position wherein in said operative rigid position the ladder is functional to allow an individual to escape from a multi-story building structure by descending downwardly a selected distance and then repositioning the emergency escape ladder in order that the individual may further descend from the structure, and so forth and so on until the individual has moved to an area of safety, said emergency escape ladder comprising in combination: a plurality of treads; flexible tie means operatively interconnected between respective treads for maintaining said treads together in a ladder assembly even when said ladder assumes said folded inoperative position; retaining means formed about an upper end of said ladder for attaching the same to a structure for supporting the emergency escape ladder while an individual is descending downwardly thereon; and a plurality of rigid stabilizing bar means for operatively interconnecting respective treads together to form an elongated rigid ladder structure for enabling the emergency escape ladder to be raised, lowered, or repositioned by an individual escaping from said multi-story structure.

2. The emergency escape ladder of claim 1 wherein said retaining means includes a hook assembly formed about the upper end of said emergency escape ladder for engaging a part of said multi-story structure such as a window ledge in order to support said emergency escape ladder as an individual descends downwardly thereon.

3. The emergency escape ladder of claim 2 wherein said retaining means includes a cable and latch assembly for effectively securing said emergency escape ladder to a structure located in the vicinity where the ladder is to extend from said cable and latch assembly including flexible cable means extendable from said emergency escape ladder for wrapping around a structure such as a chair, desk, or the like, and a latch assembly for receiving said cable and effectively coupling the same thereto such that the emergency escape ladder can be supported from a hanging position about said building structure; and wherein said latch assembly includes unlatching means for actuating and unlatching said latch assembly from the lower end of said emergency escape ladder, whereby upon actuation said unlatching means is operative to release said cable therefrom in order that said emergency escape ladder can be effectively released from the structure that the same is connected to via said cable such that the emergency escape ladder can be repositioned such that the individual may continue to descend from said multi-story building structure.

4. The emergency escape ladder of claim 1 wherein said retaining means includes a cable and latch assembly for effectively securing said emergency escape ladder to a structure located in the vicinity where the ladder is to extend from said cable and latch assembly including a flexible cable means extendable from said emergency escape ladder for wrapping around a structure, and a latch assembly for receiving said cable and effectively coupling the same thereto such that the emergency escape ladder can be supported from a hanging position; and wherein said latch assembly includes unlatching means for actuating and unlatching said latch assembly from the lower end of said emergency escape ladder, whereby upon actuation said unlatching means is operative to release said cable therefrom in order that said emergency escape ladder can be effectively released from the structure the same is connected to via said cable such that the emergency escape ladder can be repositioned such that the individual may continue to descend from said multi-story building structure.

5. The emergency escape ladder of claim 3 wherein said cable and latch assembly includes a cable and take-up reel that effectively stores said cable thereon and which is operative to allow said cable to be unwound therefrom.

6. The emergency escape ladder of claim 5 wherein said take-up reel is of the ratchet type and acts to prevent rotation of said take-up reel in a selective direction so as to enable said cable to be secured firmly around a structure or object.

7. The emergency escape ladder of claim 6 wherein said emergency escape ladder includes inner and outer sides with said inner side facing said building structure when said ladder is extended downwardly thereagainst; and wherein there is provided inward extension means that project inwardly from the respective treads for engaging said structure when said ladder extends downwardly thereadjacent for effectively spacing said treads outwardly from said building structure.

8. The emergency escape ladder of claim 1 wherein said emergency escape ladder includes inner and outer sides with said inner side facing said building structure when said ladder is extended downwardly thereagainst; and wherein there is provided inward extension means that project inwardly from the respective treads for engaging said structure when said ladder extends downwardly thereadjacent for effectively spacing said treads outwardly from said building structure.

9. The emergency escape ladder of claim 7 wherein stabilizing bar means includes a flange means disposed about opposite ends thereof and wherein each stabilizer bar means includes a threaded stud extending from one end thereof and a threaded bore formed about the other end; and wherein respective treads include an opening for receiving respective threaded studs extending from said stabilizing bar means, and wherein when said stabilizing bar means are aligned and interconnected, the threaded stud portions thereof extend through respective openings in said tread and wherein the threaded stud portions of a stabilizing bar means is threaded into a threaded bore formed about an adjacent end of another stabilizing bar means, whereby said stabilizing bar means are secured into each other and interconnected to respective treads to form a rigid emergency escape ladder.

10. The emergency escape ladder of claim 1 wherein stabilizing bar means includes a flange means disposed about opposite ends thereof and wherein each stabilizer bar means includes a threaded stud extending from one end thereof and a threaded bore formed about the other end; and wherein respective treads include an opening for receiving respective threaded studs extending from said stabilizing bar means, and wherein when said stabilizing bar means are aligned and interconnected, the threaded stud portions thereof extend through respective openings in said treads and wherein the threaded studs portion of a stabilizing bar means is threaded into a threaded bore formed about an adjacent end of another stabilizing bar means, whereby said stabilizing bar means are secured into each other and interconnected to respective treads to form a rigid emergency escape ladder.

11. The emergency escape ladder of claim 9 wherein said cable is provided with a latch connector about a remote end thereof that is adapted to be received and held by said latch assembly; and wherein said latch assembly includes a receiver for receiving said latch connector and a latching plate movable between a latch position and an unlatched position, and wherein in said latch position said latching plate is operative to engage and latch said latch connector of said cable, and wherein said latching plate is operatively connected to said stabilizing bar means and wherein said stabilizing bar means is operative upon actuation to move said latching plate from a latch position to said unlatched position such that said latch connector of said cable can be released.

12. The emergency escape ladder of claim 11 wherein said latching assembly is operatively connected between two spaced apart transversely extending bars and wherein said latching slots are journaled for rotation about the axis of one of said bars, and wherein said latching plate is pivotly connected about the axis of said one bar and is also operatively connected to said stabilizing bar means such that said latching assembly can be placed in the latched or unlatched mode by pivoting the latching plate.

13. A portable emergency escape ladder that may assume an inoperative compact storage position or may assume an operative rigid elongated extended position for enabling individuals to escape from a multi-story building structure by descending the ladder, and wherein said emergency escape ladder is particularly designed to be useful in descending from one floor level to another floor level and then repositioning the ladder for continued descent, said emergency escape ladder comprising: a plurality of treads; flexible tie means operatively interconnecting between respective threads for providing a flexible interconnecting line between said respective threads, said flexible tie means extending along opposite sides of respective threads to form a pair of laterally spaced tread ties; a plurality of stabilizing bar means operatively interconnected between respective threads and spaced generally between said pair of flexible tie means extending along each side of said treads, said stabilizing bar means connected one to another in end-to-end relationship and operatively interconnecting said threads therebetween so as to form a rigid emergency escape ladder; support means formed about an upper end of said emergency escape ladder for engaging a support structure associated with said multistory building structure such as a window ledge for supporting said emergency escape ladder in a depending relationship about said structure while an individual descends the emergency escape ladder, said support means including a pair of laterally spaced upper hook shaped arms; and a cable and latch assembly operatively associated with the upper portion of said emergency escape ladder for attaching the same to an object within said multistory building structure or to a part of the structure itself, said cable and latch assembly including, a cable having a latch connector secured thereto, latch means movable between a latch position and an unlatched position for receiving said cable connector and effectively securing the same to said latching means, whereby said cable can be secured about an object by connecting said cable connector to said latching means, and actuating means for remotely actuating said latching means to move the same from a latch position to an unlatched position such that the cable connector can be released from said latching means and the entire emergency escape ladder can be repositioned for continued descent.

14. The emergency escape ladder of claim 13 wherein said cable and latch assembly further includes a ratchet take-up reel for receiving and having said cable wound therearound.

15. The emergency escape ladder of claim 14 wherein said cable and latch assembly is disposed between said hook shaped arms.

16. The emergency escape ladder of claim 15 wherein said treads are provided with extension means for engaging the side of said multi-story building structure and maintaining the threads of said ladder outward therefrom.

17. The emergency escape ladder of claim 16 wherein said flexible tie means includes a pair of chain segments, with each chain segment being interconnected along one side of the respective treads.

* * * * *